United States Patent [19]

Fanti

[11] Patent Number: 4,828,896

[45] Date of Patent: May 9, 1989

[54] PATTERNED THERMOPLASTICS TILE AND METHOD OF MAKING SAME

[75] Inventor: Luigi Fanti, Styvechale, United Kingdom

[73] Assignee: Courtaulds PLC, United Kingdom

[21] Appl. No.: 61,882

[22] Filed: Jun. 11, 1987

[30] Foreign Application Priority Data

Dec. 1, 1986 [GB] United Kingdom ..... 8628691

[51] Int. Cl.[4] ..... B44C 1/28; B44F 11/04

[52] U.S. Cl. ..... 428/67; 156/303.1; 428/47; 428/48; 428/50; 428/151

[58] Field of Search ..... 428/47, 48, 67, 50, 428/151; 156/303.1

[56] References Cited

U.S. PATENT DOCUMENTS

| | | | |
|---|---|---|---|
| 1,752,402 | 4/1930 | Tomec et al. | 428/47 |
| 2,108,226 | 2/1938 | Johnston | 52/387 X |
| 2,995,179 | 8/1961 | Scolamiero | 428/67 |
| 3,152,002 | 10/1964 | Wisotzky et al. | 428/147 |
| 3,466,223 | 9/1969 | Beeler et al. | 428/213 |
| 3,559,231 | 2/1971 | Hill | 428/167 X |
| 3,953,932 | 5/1976 | Graves | 156/303.1 X |
| 4,239,797 | 12/1980 | Sachs | 428/48 X |
| 4,476,174 | 10/1984 | Carrera | 428/67 |
| 4,486,371 | 12/1984 | Caliri | 428/67 X |
| 4,761,317 | 8/1988 | Ebata et al. | 428/67 |

FOREIGN PATENT DOCUMENTS

| | | |
|---|---|---|
| 1418943 | 10/1964 | France . |
| 1464881 | 11/1965 | France . |
| 367264 | 6/1931 | United Kingdom . |
| 2214458 | 10/1960 | United Kingdom . |
| 851286 | 10/1960 | United Kingdom . |
| 3040958 | 6/1961 | United Kingdom . |
| 870134 | 6/1961 | United Kingdom . |
| 1661861 | 3/1964 | United Kingdom . |
| 951689 | 3/1964 | United Kingdom . |
| 4473364 | 11/1967 | United Kingdom . |
| 1089845 | 11/1967 | United Kingdom . |
| 1207685 | 10/1970 | United Kingdom . |
| 1382619 | 1/1972 | United Kingdom . |
| 5145372 | 7/1975 | United Kingdom . |
| 1400233 | 7/1975 | United Kingdom . |

*Primary Examiner*—Henry F. Epstein

*Attorney, Agent, or Firm*—Howson & Howson

[57] ABSTRACT

A plastics tile has a back ply having raised areas on one face which define at least one recess and a slug of facing material bonded in the or each recess. The slug or slugs are desirably either flush with or slightly proud of the raised areas of the back ply.

6 Claims, 1 Drawing Sheet

PATTERNED THERMOPLASTICS TILE AND METHOD OF MAKING SAME

TECHNICAL FIELD

This invention relates to the production of tiles from synthetic plastics material, for example, floor tiles.

DISCUSSION OF PRIOR ART

Some plastics floor tiles are at present manufactured by using slugs, that is pieces of plastics material, which are bonded to a plastics back ply leaving gaps between the slugs through which the back ply is visible. In this way a tile can be manufactured which carries a pattern created by the arrangement of the slugs and the area of each slug in this pattern is clearly shown by the gap surrounding it and separating it from other slugs and in which the material of the back ply is visible. Such a manufacturing procedure is particularly useful in producing tiles carrying a pattern which simulates wooden parquet flooring.

A disadvantage of tiles produced in this way is that the gaps between slugs, essential to achieve the pattern effect desired, are receptacles for dirt particles and are difficult to clean. This can render such tiles unacceptable or undesirable for use in some situations such as hospitals, food stores or kitchens since the dirt retained can be a reservoir for bacteria. It can also be disfiguring and may render the tile unattractive.

OBJECT OF THE INVENTION

The object of the present invention is to provide a method of manufacturing tiles which can enable a similar patterned appearance to that described above to be achieved but without the disadvantage of leaving gaps between the slugs which can collect dirt but which also enables new pattern effects to be achieved, especially if hygiene requirements are set no higher than with previous tiles.

SUMMARY OF THE INVENTION

According to the invention, a method of making a plastic tile comprises molding a back ply for the tile having raised areas on one surface defining at least one recess for reception of at least one slug, inserting a slug or slugs into the recess or recesses and subjecting the back ply and slug or slugs to a treatment to bond them together.

The invention includes a plastics tile comprising a back ply having raised areas on one surface defining at least one recess, and one or more slugs received in the said recess or recesses and bonded to the back ply.

BRIEF DESCRIPTION OF THE DRAWING

The invention will be further described, by way of example, with reference to the accompanying drawing in which.

DESCRIPTION OF PREFERRED EMBODIMENTS

Figure 1:
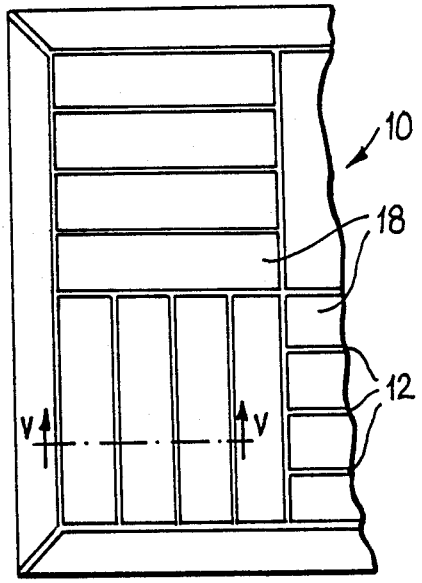
FIG. 1 is a plan of part of a tile according to the invention.
Figure 4:
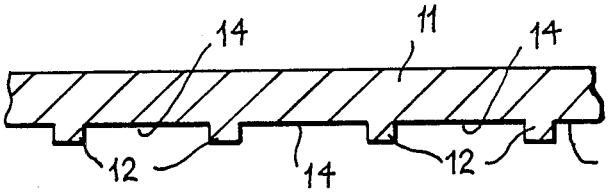
FIG. 4 is a cross-section through part of a back ply for the tile of FIG. 1.
Figure 5:
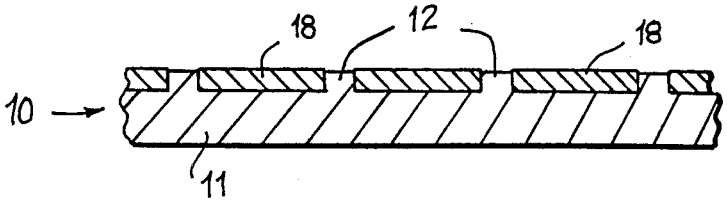
FIG. 5 is a cross-section through part of the tile of FIG. 1 taken on the line V—V of FIG. 1.

The tile 10 of FIGS. 1 and 5 is a floor tile made of polyvinyl chloride (PVC), a thermoplastic material, and has a pattern which simulates wooden parquet flooring. The tile 10 comprises a back ply 11 of black PVC (FIG. 4) which is formed with raised areas 12 on one surface 13. The raised areas 12 define a number of recesses 14 on the surface 13 and in the embodiment shown comprise series of parallel, narrow ribs, the ribs of adjacent series being arranged at right angles to one another in such a way that each recess 14 has a rectangular shape, each series of recesses 14 comprises four parallel rectangles and each tile 10 has four series of recesses 14. Around the perimeter of each tile 10 are four recesses 14, one along each side of the tile, which are bounded by raised areas 12 only on their inner edges and at each end.

The tile of FIG. 1 is made in a platen press constructed according to known principles and adapted to receive several molds at one time. To make back plies for tiles, each mold is placed on a platen in the press with a sheet of PVC on top of the mold, and the platens originally spaced apart vertically, are pushed together by a ram and are heated. Thus each mold is pressed towards the platen immediately above it by the platen immediately below it and each sheet of PVC is compressed between the associated mold and the platen immediately above it. Each sheet of PVC is thus embossed with the pattern on the mold.

Figure 3:
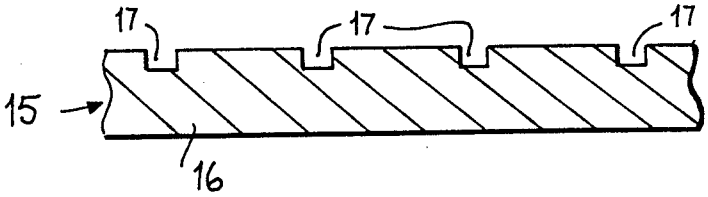
FIG. 3 is a cross-section through part of a mold for use in the production of tiles according to the invention.

Part of a mold 15 for the back ply of a tile according to the present embodiment of the invention is shown in FIG. 3 and comprises a metal platen 16 formed with grooves 17 for molding the ribs 12.

When the back ply 11 has been molded, it is inserted into another press on a flat mold after slugs 18 of PVC have been inserted, one into each recess 14. Each slug 18 is shaped to fit snugly into a corresponding recess 14 with close tolerance and in the case of the present rectangular recesses 14 and slugs 18, all the rectangular recesses and slugs are the same size and shape.

After insertion in the press, as mentioned, the slugs 18 and back ply 11 are bonded to one another by a treatment comprising applying heat and pressure to them in the press. This softens the thermoplastics material of each and causes them to adhere together. The tile is then complete except that normally sheets of PVC large enough to provide the back plies of a number of individual tiles, and correspondingly large molds and presses, will be used so that after bonding of the slugs to a sheet of PVC constituting a number of back plies, the sheet of PVC will require to be cut to divide it into individual tiles.

The raised areas 12 are advantageously, after bonding of the back ply 11 to the slugs 18, flush with or slightly recessed with respect to the outer surfaces of the slugs (but not so recessed as to provide a channel which will retain any substantial quantity of dirt, which is difficult to clean out). In the embodiment just described, using a black PVC for the back ply 11 and slugs which carry a pattern simulating a wooden surface, the resulting tiles simulate parquet flooring but the spaces between the individual slugs, being filled with the ribs constituted by the raised areas 12, do not harbour significant quantities of dirt in use and the whole surface of the tile being flush and without substantial recesses is easy to clean and can be maintained to standards of hygiene which make it more acceptable for use in some applications for which previous tiles with parquet floor patterning were not acceptable.

Tiles according to the invention are not restricted to parquet floor patterns or to other geometrically regular patterns or to raised areas constituted by narrow ribs such as the raised areas 12 (FIGS. 1, 4 and 5). The invention thus extends to a plastics tile including a plurality of recesses filled by a plurality of slugs producing a patterned effect at the surface of the tile.

Figure 2:
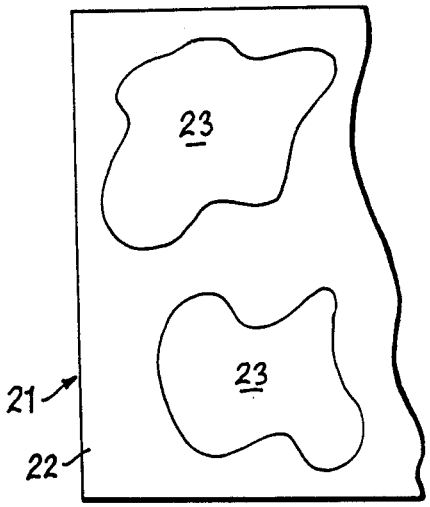
FIG. 2 is a plan of part of another tile according to the invention.

FIG. 2, for example shows part of a tile 21 in which raised areas 22 on a back ply of the tile are continuous with one another (as are the ribs constituting the raised areas 12) and define irregularly shaped recesses which receive correspondingly shaped slugs 23 to a close tolerance, so that the surfaces of the slugs 23 are flush, or approximately flush, with the raised areas 22 and there are substantially no gaps between the slugs and the raised areas. By choosing the material of the back ply and raised areas 22 of one color and the slugs 23 of another color, or several different colors, attractive patterns can be achieved.

If desired, more than one slug may be located in a recess on the back ply to further diversify the types of pattern achievable. Of course, if pattern is the primary object and hygienic considerations need not be taken into account any more than with previous tiles, some gaps may be left between slugs and raised or other recesses may be left on the tile surface to achieve particular relief effects.

Materials other than thermoplastics may be used to manufacture tiles according to the invention and the slugs may be bonded to the back ply by separate adhesives. Tiles according to the invention may be used for purposes other than flooring.

The invention is not limited to the specific methods or designs described with reference to the drawings, since modifications of these methods or designs are clearly possible within the spirit and scope of the following claims.

What is claimed is:

1. A patterned thermoplastics tile including:

(a) a thermoplastic back ply of a given color and having a front surface premolded with a pattern or raised areas on said front surface which define a plurality of recesses in which are located (b) correspondingly shaped inserts of thermoplastic material of a different color from that of the back ply, which inserts are thermoplastically fused to the back ply, there being one insert in each said recess and each insert comprising at least one slug of thermoplastic material.

2. A patterned thermoplastics tile according to claim 1, in which the thermoplastic material of both slugs and back ply includes polyvinyl chloride.

3. A patterned thermoplastics tile according to claim 2, wherein the surfaces of the raised areas of the back ply and of the slugs are flush with each other.

4. A patterned thermoplastics tile according to claim 3, which simulates wooden parquet flooring wherein the raised areas of the back ply include narrow ribs and the slugs comprise geometric shapes colored and patterned like wood and located between said narrow ribs.

5. A patterned thermoplastics tile according to claim 1 in which the bottoms of said recesses are substantially flat and in which the recesses are defined by side walls of said raised areas, the side walls being substantially perpendicular to said flat bottoms.

6. A method of making a patterned thermoplastics tile said method including the following steps:

(a) molding a back ply for said tile from thermoplastic material of a given color in which the back ply is molded with a pattern of raised areas on one surface which define a plurality of recesses for reception of slugs;

(b) following the formation of said pattern of raised areas and said plurality of recesses, taking the molded back ply and inserting in said recesses correspondingly shaped slugs of thermoplastic material having a different color from that of the back ply;

(c) placing the molded back ply with the inserted slugs in a press and therein applying heat and pressure to said back ply and slugs to soften the respective thermoplastic materials and fuse them together; and (d) removing from the press the resulting patterned thermoplastic tile.

* * * * *